US007364156B2

(12) United States Patent
Wanibuchi et al.

(10) Patent No.: US 7,364,156 B2
(45) Date of Patent: Apr. 29, 2008

(54) DATA PROCESSING APPARATUS

(75) Inventors: Hiroshi Wanibuchi, Shiojiri (JP); Katsuyuki Kondo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 362 days.

(21) Appl. No.: 11/251,050

(22) Filed: Oct. 14, 2005

(65) Prior Publication Data

US 2006/0082050 A1 Apr. 20, 2006

(30) Foreign Application Priority Data

Oct. 19, 2004 (JP) ..... 2004-303855

(51) Int. Cl.
*B65H 5/00* (2006.01)
*B65H 5/02* (2006.01)
*G03G 21/00* (2006.01)

(52) U.S. Cl. ..... 271/264; 271/272; 399/124; 399/125

(58) Field of Classification Search ..... 271/264, 271/272, 273, 274; D18/38, 39, 40, 53, 56; 399/124, 125; 347/101, 104, 105; 400/642, 400/643, 645.4, 645.5, 647, 647.1
See application file for complete search history.

(56) References Cited

U.S. PATENT DOCUMENTS 5,802,426 A * 9/1998 Miyazaki et al. ..... 399/113
6,829,453 B2 * 12/2004 Kouzu ..... 399/124
7,203,448 B2 * 4/2007 Yokoi ..... 399/124
2003/0151653 A1 8/2003 Hidehiko et al.
2005/0196216 A1 * 9/2005 Tanahashi et al. ..... 400/625
2005/0214027 A1 * 9/2005 Yasumoto ..... 399/124

FOREIGN PATENT DOCUMENTS

| | | |
|---|---|---|
| JP | 63-286860 | 11/1988 |
| JP | 63 286860 A | 11/1988 |
| JP | 10-279123 | 10/1998 |
| JP | 11-106085 | 4/1999 |
| JP | 11-106086 | 4/1999 |
| JP | 2003-154693 | 5/2003 |
| JP | 2003-201041 | 7/2003 |

OTHER PUBLICATIONS

European Search Report dated Feb. 1, 2006.

* cited by examiner

*Primary Examiner*—Dave Bollinger
*Assistant Examiner*—Luis A Gonzalez
(74) *Attorney, Agent, or Firm*—John J. Penny, Jr.; Edwards Angell Palmer & Dodge LLP

(57) ABSTRACT

A data processing apparatus having a construction for guiding a transported medium conveyed from a curved transportation unit enables opening and closing the guide unit. The data processing apparatus 1 has an intermediate roller 39 and guide portion 38 constituting a curved transportation unit 23 inside the printer case 7, and a paper feed roller pair 25 and 26 for nipping and conveying paper P conveyed from the curved transportation unit 23 disposed a specific distance from the curved transportation unit 23. The guide portion 38 has an auxiliary guide member 51 and can move circularly open and closed in unison with an outside wall unit 16. The auxiliary guide member 51 projects toward the paper feed roller pair 25 and 26 and guides the paper P. An auxiliary guide linking mechanism 53 causes the auxiliary guide member 51 to retract away from the paper feed roller pair 25 and 26 in conjunction with the unlocking operation of opening/closing levers 41 and 42.

8 Claims, 14 Drawing Sheets

DATA PROCESSING APPARATUS

Priority is claimed to Japanese Application No. 2004-303855 filed on Oct. 19, 2004, which is hereby incorporated by reference in its entirely.

BACKGROUND OF THE INVENTION

1. Field of Technology

The present invention relates to a data processing apparatus having an intermediate roller forming the inside surface of a curved transportation unit that is curved in an arc shape, a guide forming the outside surface of this curved transportation unit, and a pair of paper transportation rollers, which nip and convey a transported medium delivered from the curved transportation unit to a processing position, disposed at a position separated a specific distance from the output end of the curved transportation unit.

2. Description of Related Art

A printer connected to a personal computer, for example, is described below as an example of a data processing apparatus according to the present invention.

Disposed inside the housing that provides the external appearance of a printer are a transportation mechanism for conveying paper as the transported medium from a paper tray, cassette, or other storage unit one sheet at a time along a specific transportation path, a recording unit disposed at some intermediate position along the transportation path for recording text, graphics, or other images to the conveyed paper, and various operating devices such as a recording unit drive mechanism for imparting a specific motion to the recording unit as needed for printing.

In order to reduce the footprint and reduce the size of the printer, some printers have both the paper feed unit and the discharge unit for discharging the printed paper disposed to feed and discharge the paper from openings at the front of the printer. This type of printer typically has a paper cassette used to store paper for supplying to the print unit disposed at the bottom front part of the printer housing, and a discharge tray onto which the printer paper is deposited after printing disposed above the paper cassette. A substantially U-shaped transportation path connecting the paper cassette to the discharge tray is rendered inside the housing, and the recording unit is disposed to this U-shaped transportation path.

The U-shaped transportation path inside the housing is composed of a curved transportation unit, a paper feed roller pair, and a discharge transportation mechanism. The curved transportation unit starts from the paper cassette storing the paper, and has an intermediate roller unit and a guide portion that curves around the roller unit. The paper feed roller pair is located a specific distance from the output end of the curved transportation unit. The discharge transportation mechanism guides the paper past the recording unit, which is located downstream from the paper feed roller pair, to the discharge tray at the front of the printer.

A problem with this arrangement is that paper jams occur easily inside the curved transportation unit and in the area from the curved transportation unit to the paper feed roller pair due to skewing and curling in the leading end of the paper. To avoid this problem, Japanese Unexamined Patent Appl. Pub. 2003-154693 teaches a contact release mechanism for separating the rollers of the transportation unit from the paper when a paper jam occurs.

The contact release mechanism taught in Japanese Unexamined Patent Appl. Pub. 2003-154693 releases the roller pressure on the paper when the jammed end of the paper is held to extract the paper from the paper supply or paper discharge side, so that the paper can be easily removed.

In addition, Japanese Patent 2529261 teaches an arrangement for exposing the curved transportation unit for access from the outside by pivoting the guide portion of the curved transportation unit open and closed in conjunction with the external cover of the housing in order to facilitate removing jammed paper that is stuck inside the printer due to a paper jam in the U-shaped transportation path.

In order to prevent paper jams in the U-shaped transportation path described above, the curling and skewing at the leading end of the paper that cause paper jams must be prevented between the curved transportation unit and the paper feed roller pair. However, if the guide portion of the curved transportation unit that guides the paper between the curved transportation unit and the paper feed roller pair is extended to the paper feed roller pair, opening the guide portion of the curved transportation unit when a paper jam occurs interferes with other members inside the housing and it is thus difficult to expose the curved transportation unit for access from outside the housing.

A data processing apparatus according to at least one embodiment of the present invention having a structure for guiding paper (transported medium) from a curved transportation unit to a paper feed roller pair makes it possible to externally expose the curved transportation unit by opening a closable guide portion, thus affording highly stable transportation through the U-shaped transportation path and easy removal of a transported medium jammed inside the transportation path.

SUMMARY OF THE INVENTION

A data processing apparatus according to at least one embodiment of the present invention has a guide unit having an intermediate roller and an arc-shaped guide surface composing a substantially arc-shaped curved transportation unit inside an external case, and a paper feed roller pair, which nips and conveys a transported medium conveyed from said curved transportation unit toward a processing position and is disposed at a specific distance from a discharge end of said curved transportation unit. The guide unit has an auxiliary guide member which projects from said discharge end of said curved transportation unit toward said paper feed roller pair and guides said transported medium conveyed toward said paper feed roller pair. This guide unit is rendered to move circularly and open and close in unison with an outside wall portion of said external case positioned on the outside of said guide unit. This data processing apparatus also has opening/closing levers for locking and unlocking a lock unit which restricts circular motion of said guide unit in a closed position, and an auxiliary guide linking mechanism for retracting said auxiliary guide member in a direction separating from said paper feed roller pair in conjunction with said unlocking operation of said lock unit by said opening/closing levers.

As a result of having an auxiliary guide member to guide the transported medium conveyed from the curved transportation unit to the paper feed roller pair, the data processing apparatus according to this embodiment of the invention can reliably convey the transported medium between the curved transportation unit and the paper feed roller pair. Furthermore, because the auxiliary guide member retracts away from the paper feed roller pair in conjunction with the unlocking action of the opening/closing levers unlocking the lock unit, the auxiliary guide member can swing the guide unit open without interference with other components inside the housing, and the curved transportation unit can be exposed to the outside for access. As a result, if by some chance the transported medium becomes jammed inside, the guide unit can be opened and the transported medium removed as easily as when the auxiliary guide member is not present.

The auxiliary guide member preferably advances and retracts in the direction of said paper feed roller pair in conjunction with movement between said unlocked position and said locked position of said lock unit.

When the lock unit is engaged in the locked position with the guide unit in the closed position, the auxiliary guide member is positioned in conjunction with this movement from the discharge end of the curved transportation unit to a position projecting to the paper feed roller pair. As a result, when the data processing apparatus is driven to convey the transported medium, the transported medium can be reliably and consistently guided from the curved transportation unit to the paper feed roller pair.

Yet further preferably, the auxiliary guide linking mechanism of this data processing apparatus has a first rack which moves linearly in conjunction with an unlocking operation of said opening/closing levers; a first pinion which meshes with said first rack and rotates in conjunction with linear movement of said first rack; a second pinion which rotates codirectionally to said first pinion; and a second rack which has teeth which mesh with said second pinion arrayed in the retracting direction of said auxiliary guide member, and retracts said auxiliary guide member as a result of linear motion of said second rack in conjunction with rotation of said second pinion.

By changing the gear ratio of the first pinion and second pinion, the data processing apparatus according to this embodiment of the invention can freely adjust the linear distance of second rack movement. As a result, the linear distance of auxiliary guide member movement can be set freely without being restricted by the amount of opening/closing lever movement needed for locking and unlocking, and an auxiliary guide member that projects the required sufficient length can be smoothly advanced and retracted.

Yet further preferably, this data processing apparatus also has stops which contact said opening/closing levers in said unlocked position when said guide unit is in said open position, and hold said lock unit in said unlocked position.

When the opening/closing levers are unlocked and the guide unit starts to open in order to remove a transported medium stuck inside this data processing apparatus, one end of the lock units is held in the unlocked position by the stops. The opening/closing levers are thus held in the unlocked (released) position even after the opening/closing levers are released by the hand that unlocked the levers, and the guide unit can thus be easily opened and closed. Furthermore, because the auxiliary guide member is held in the retracted position when the guide unit is open, the auxiliary guide member does not interfere with removing the jammed transported medium.

Furthermore, after the stuck transported medium is removed, the lock unit is held in the unlocked position by the stops when the guide unit is closed until the guide unit reaches the normal closed position. As a result, the auxiliary guide member can be held in the retracted position without operating the opening/closing levers, and the guide unit can be returned to the closed position without the auxiliary guide member striking other members.

Yet further preferably, the lock unit of this data processing apparatus is elastically urged toward said locked position.

The guide unit can thus be reliably held in the closed position during normal operation of the data processing apparatus because the lock unit is always positioned in the locked position except when it is unlocked by the opening/closing levers. Furthermore, if the guide unit is returned to the closed position when these stops are present, the lock unit is disengaged from the stops, the lock unit automatically returns to the locking position, and the guide unit is fixed in the closed position. As a result, the action of closing the guide unit is greatly simplified.

Yet further preferably, the auxiliary guide member of this data processing apparatus is housed in a flange member, which moves circularly in conjunction with said outside wall portion when said auxiliary guide member retracts away from said paper feed roller pair.

The data processing apparatus thus arranged prevents the auxiliary guide member from contacting and damaging other parts of the apparatus because the guide unit opens and closes with the auxiliary guide member housed inside the flange member.

A data processing apparatus according to at least one embodiment of the present invention thus has an auxiliary guide member for guiding a transported medium conveyed from a curved transportation unit to a paper feed roller pair. The transported medium can thus be reliably conveyed between the curved transportation unit and paper feed roller pair. Furthermore, the auxiliary guide member retracts away from the paper feed roller pair in conjunction with releasing a lock unit by means of opening/closing levers. Opening the guide unit thus exposes the curved transportation unit to the outside, thereby enabling jammed transported media to be easily removed.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Preferred embodiments of a data processing apparatus according to the present invention are described below with reference to the accompanying figures.

Figure 1:
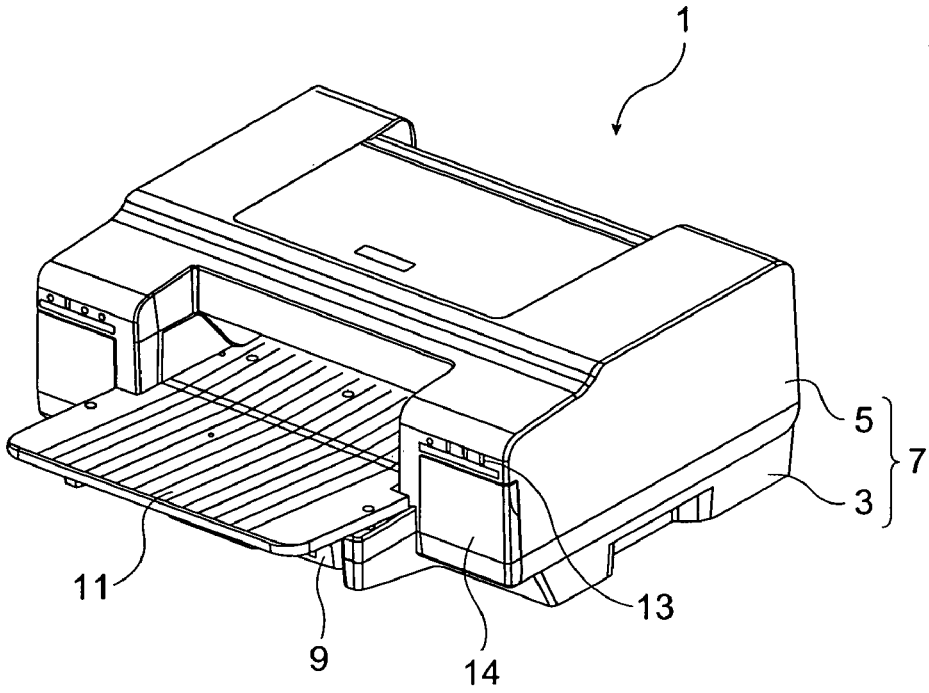
FIG. 1 is an oblique view from above the front of a data processing apparatus according to the present invention.
Figure 2:
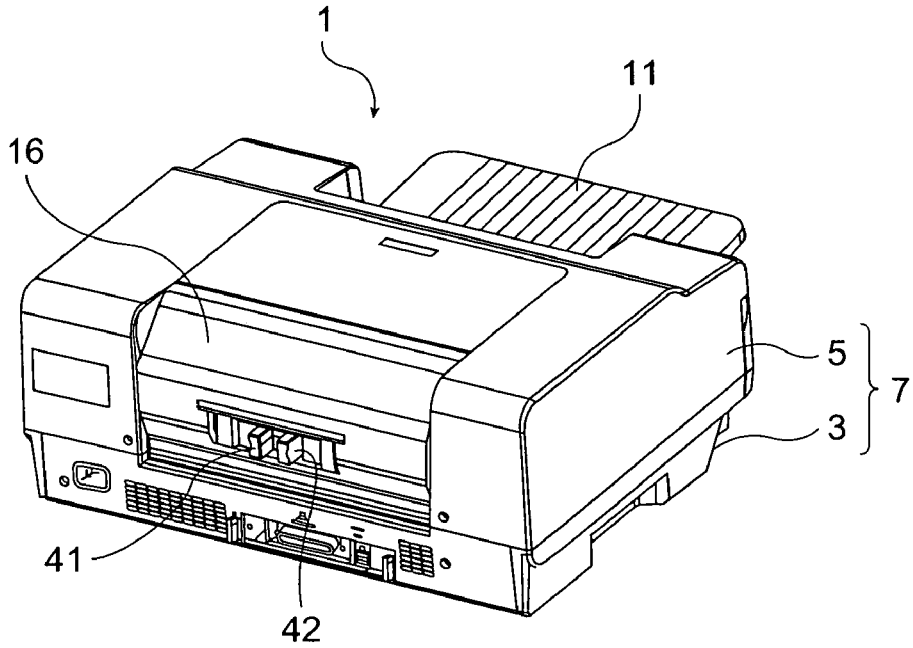
FIG. 2 is an oblique view from above the back of a data processing apparatus according to the present invention.
Figure 3:
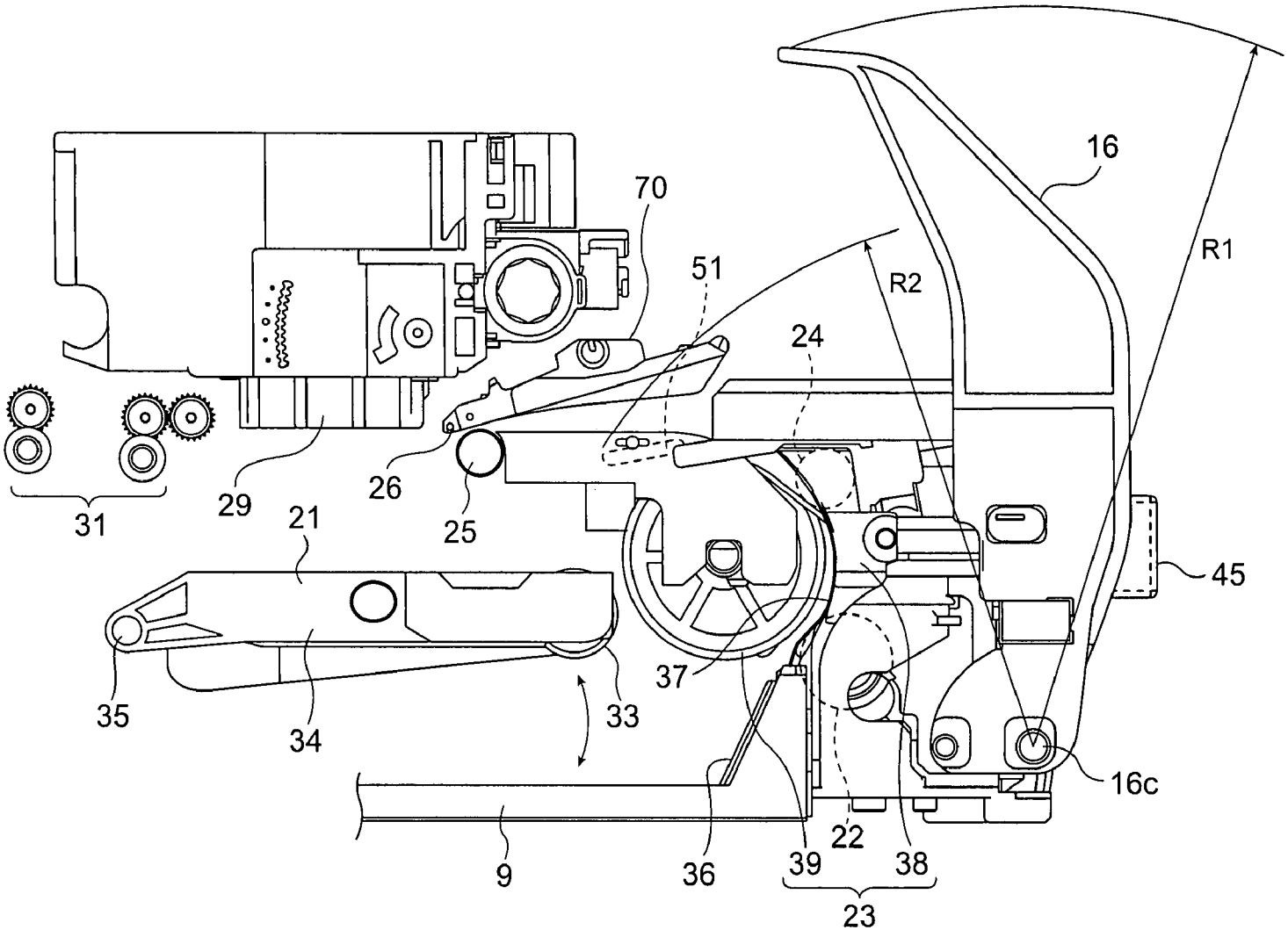
FIG. 3 is a side section view showing the paper supply mechanism when the data processing apparatus shown in FIG. 1 is at rest.
Figure 4:
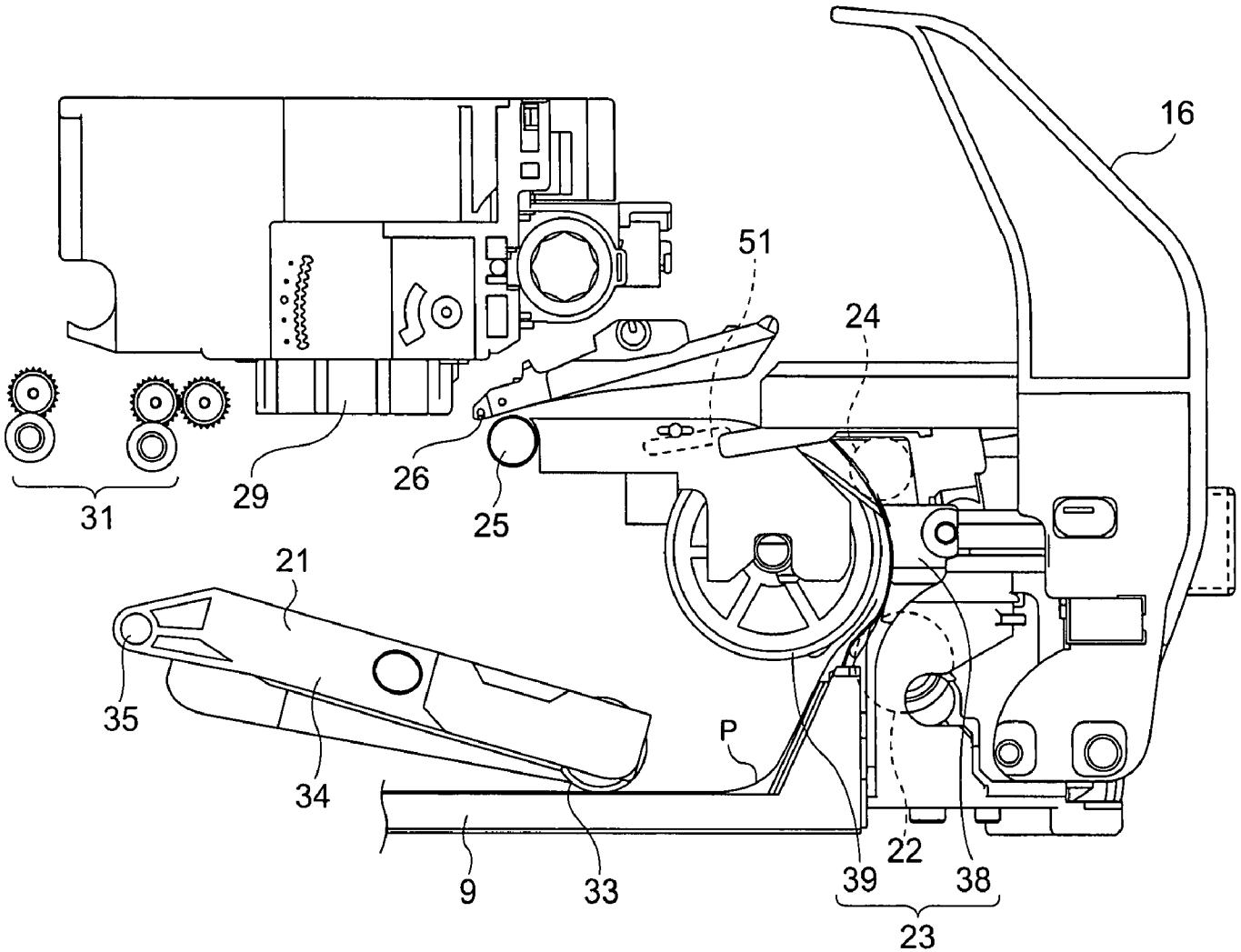
FIG. 4 is a side section view showing the paper supply mechanism of the data processing apparatus shown in FIG. 1 when feeding paper.
Figure 5:
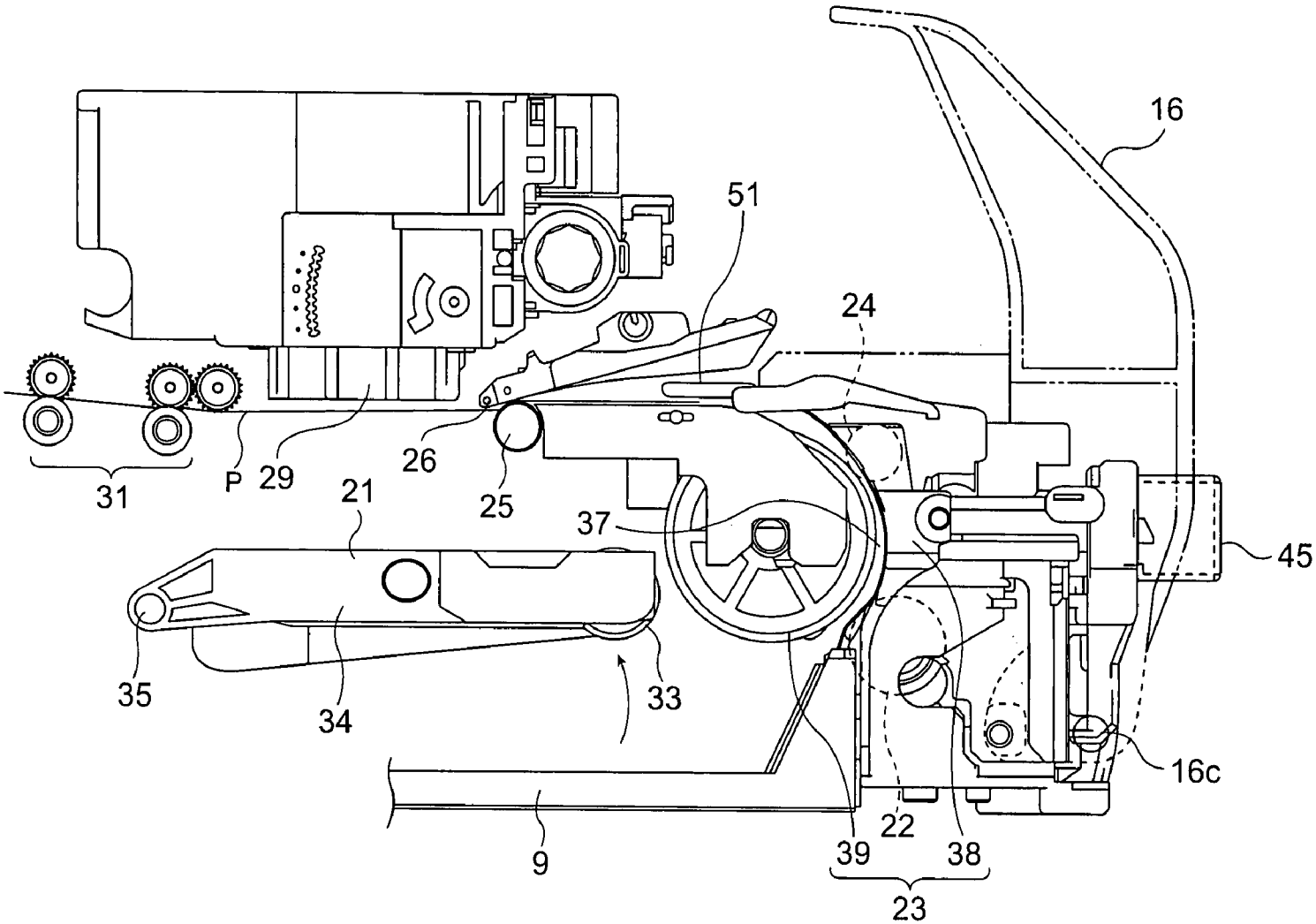
FIG. 5 is a side section view showing the data processing apparatus shown in FIG. 1 during printing.
Figure 6:
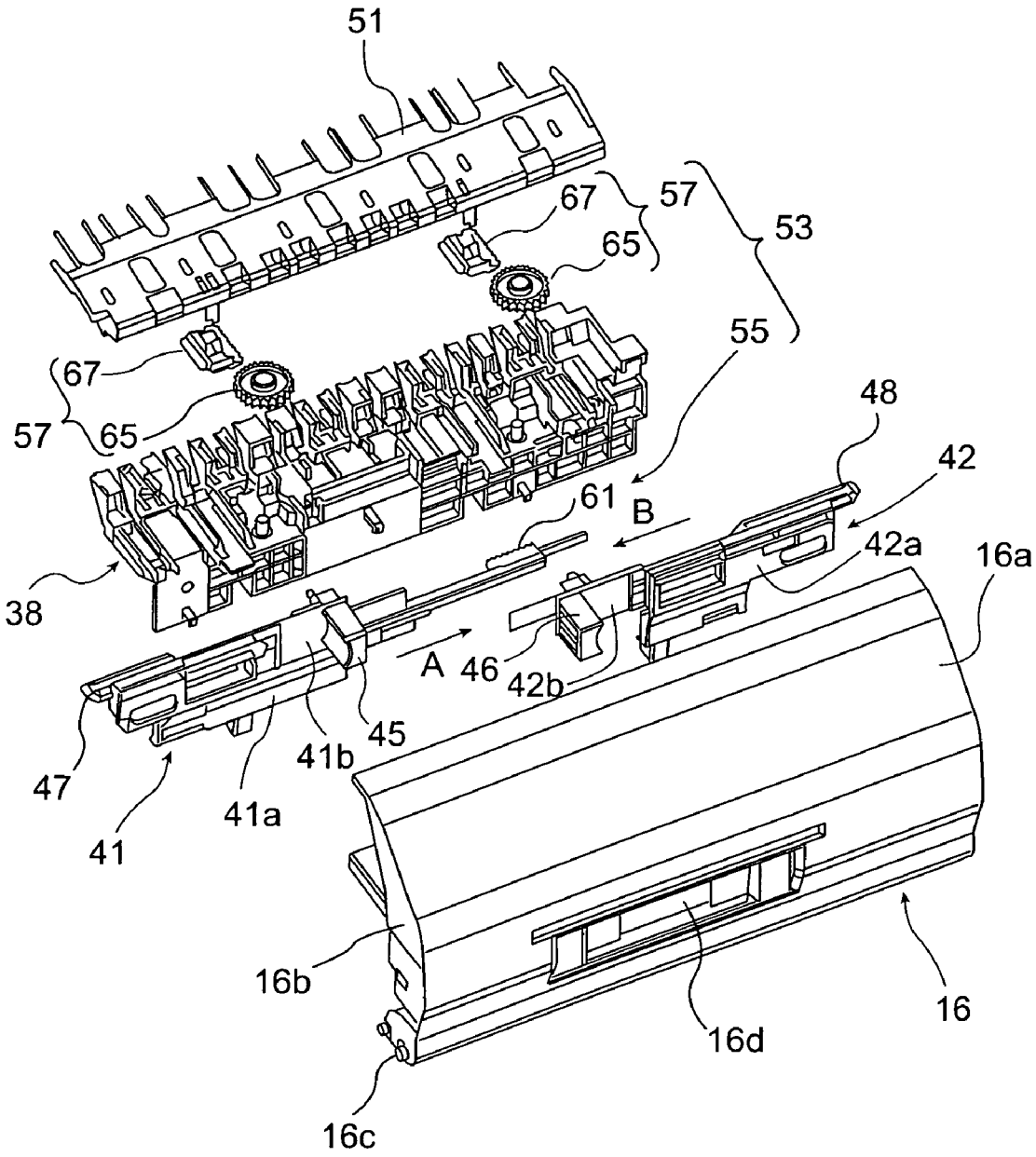
FIG. 6 is an oblique exploded view from the back of the opening/closing cover and guide portion shown in FIG. 3.
Figure 7:
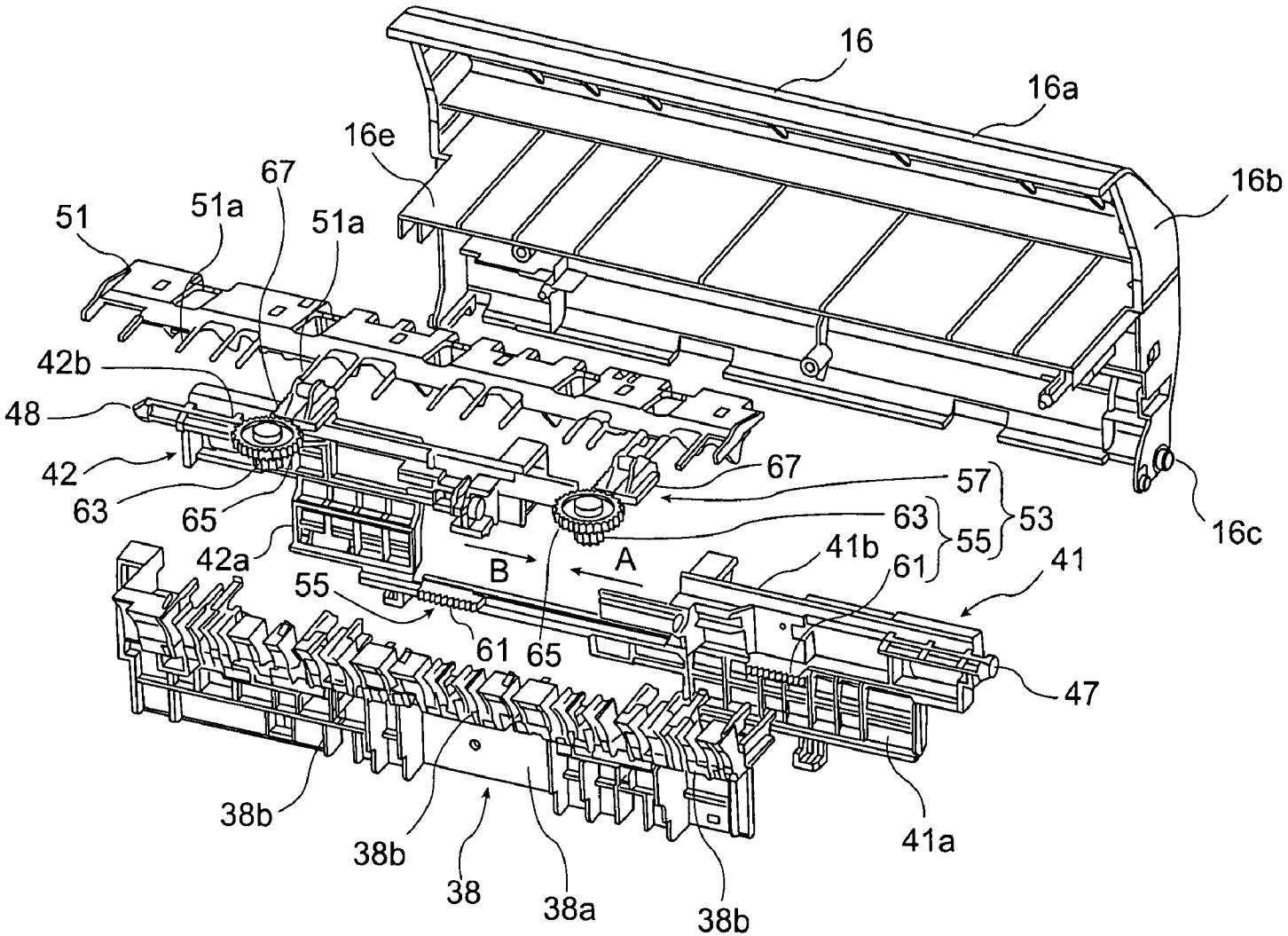
FIG. 7 is an oblique exploded view from the front of the opening/closing cover and guide portion shown in FIG. 3.

FIG. 1 to FIG. 7 show a preferred embodiment of a data processing apparatus according to the present invention. FIG. 1 is an oblique view from above the front of a data processing apparatus according to the present invention, FIG. 2 is an oblique view from above the back of a data processing apparatus according to the present invention, FIG. 3 is a side section view showing the paper supply mechanism when the data processing apparatus shown in FIG. 1 is at rest, FIG. 4 is a side section view showing the paper supply mechanism of the data processing apparatus shown in FIG. 1 when feeding paper, FIG. 5 is a side section view showing the data processing apparatus shown in FIG. 1 during printing, FIG. 6 is an oblique exploded view from the back of the opening/closing cover and guide portion shown in FIG. 3, and FIG. 7 is an oblique exploded view from the front of the opening/closing cover and guide portion shown in FIG. 3.

A data processing apparatus 1 according to this embodiment of the invention is a front loading, front discharge type of business printer. As shown in FIG. 1, a box-like paper cassette 9 for holding paper as the transported medium can be freely installed to and removed from the front of the center area of the printer case 7. The printer case 7 is composed of a bottom case 3 and a top case 5. A discharge tray 11 for receiving printed paper is disposed covering the top open portion of the paper cassette 9. A display unit 13 for displaying the operating status, for example, and an operating panel 14 are disposed on both sides at the front of the printer case 7.

As shown in FIG. 3 to FIG. 5, a paper supply mechanism 21, a curved transportation unit 23, a paper feed roller pair 25 and 26, a recording unit 29, and a discharge transportation mechanism 31 are assembled inside the printer case 7.

The paper supply mechanism 21 supplies paper P stored in the paper cassette 9 one sheet at a time into the transportation path. The curved transportation unit 23 conveys the paper P supplied from the paper supply mechanism 21 through the curved transportation path, and the paper feed roller pair 25 and 26 then nip and feed the paper P from the curved transportation unit 23 to the processing position. The recording unit 29 records text, graphics, or other images to the paper P at a flat transportation portion downstream from the paper feed roller pair 25 and 26. The discharge transportation mechanism 31 then discharges the paper P after printing by the recording unit 29 is finished onto the discharge tray 11 at the front of the case.

Note that the paper feed roller pair 25 and 26 includes a drive roller 25 and a complementary roller 26.

The paper cassette 9, curved transportation unit 23, paper feed roller pair 25 and 26, discharge transportation mechanism 31, and discharge tray 11 inside the printer case 7 constitute a U-shaped transportation path for conveying paper P delivered from the paper cassette 9 at the bottom front one sheet at a time to the back of the printer while the curved transportation path changes the direction of paper transportation back to the front of the printer.

The paper supply mechanism 21 rotates up and down as seen in the figures by pivoting on a support pin 35 disposed at the back end of frame 34, which has a pickup roller 33 at its distal end for delivering paper. The pickup roller 33 of this paper supply mechanism 21 can thus be placed in contact with the top-most sheet of paper P in the paper cassette 9 as a result of the frame 34 swinging up and down. When the data processing apparatus 1 is at rest, the paper supply mechanism 21 is held with the frame 34 horizontal as shown in FIG. 3, and the pickup roller 33 is held separated from the paper P in the paper cassette 9.

When paper is fed into the data processing apparatus 1, the frame 34 swings down pivoting on the support pin 35 so that the pickup roller 33 is pressed against the paper P in the paper cassette 9 as shown in FIG. 4. Rotation of the pickup roller 33 then pushes the paper P in the paper cassette 9 against the inclined separation pad 36, thus feeding one sheet at a time toward the curved transportation unit 23 as the top sheet of paper P is separated from the stack by friction and the stiffness of the paper P. When paper feeding is completed and the recording unit 29 starts printing, the frame 34 returns to the horizontal position as shown in FIG. 5.

As shown in FIG. 3 to FIG. 5, the curved transportation unit 23 has a guide portion 38 and an intermediate roller 39. The guide portion 38 is disposed on the outside side of the transportation path (that is, on the side toward the back of the data processing apparatus 1) and has a guide surface 37 that curves in an arc. The intermediate roller 39 is disposed on the inside side of the transportation path (that is, toward the front of the data processing apparatus 1 relative to the guide portion 38) and conveys the paper P from the bottom to the top of the guide portion 38.

A retard roller 22 is disposed at the bottom of the guide portion 38 and an assist roller 24 is disposed at the top. Paper P delivered by the pickup roller 33 is thus nipped and conveyed by the intermediate roller 39 and retard roller 22, and then nipped and conveyed by the intermediate roller 39 and assist roller 24. The paper P is thus conveyed through the curved transportation path, and the leading end of the paper is directed toward the front of the printer to the straight portion of the U-shaped transportation path.

The paper feed roller pair 25 and 26 is disposed at a specific distance toward the front of the printer from the output end of the curved transportation path (the downstream end from the curved transportation unit 23), and as shown in FIG. 5 holds and conveys the paper P delivered to the substantially straight portion of the transportation path from the curved transportation unit 23 to the processing position below the recording unit 29.

As shown in FIG. 2 to FIG. 6, the outside wall part at the back of the printer case 7 located behind the guide portion 38 is an opening/closing cover 16 which can be opened and closed by an unlocking/locking operation of a pair of sliding opening/closing levers 41 and 42. The guide portion 38 is attached in unison with the inside of this opening/closing cover 16. As a result, opening the opening/closing cover 16 also exposes the curved transportation path to the outside.

The arrangement enabling the opening/closing cover 16 to open and close, and the guide portion 38 attached in unison to the opening/closing cover 16, are further described below.

As shown in FIG. 6, the opening/closing cover 16 has a curved back wall 16*a* and substantially crescent-shaped side walls 16*b* formed on opposite ends in unison with the back wall 16*a*. A support pin 16*c* protrudes to the outside from the bottom of each side wall 16*b*.

These support pins 16*c* fit and pivot freely in matching portions of the printer case 7, and thus connect the opening/closing cover 16 to the printer case 7 so that the opening/closing cover 16 can swing through a radius of movement R1 with a pivot point at support pins 16*c*. An eave-like shelf 16*e* is formed in unison with the opening/closing cover 16 projecting toward the inside the case as shown in FIG. 7.

As shown in FIG. 6 and FIG. 7, the opening/closing levers 41 and 42 attached to the opening/closing cover 16 are composed of slide guides 41*a*, 42*a*, levers 41*b*, 42*b*, and a spring (not shown in the figure) urging the levers 41*b*, 42*b* in opposite directions. The slide guides 41*a*, 41*b* are installed to the back of the opening/closing cover 16, and support the levers 41*b*, 42*b* so that the levers 41*b*, 42*b* can slide linearly in the direction widthwise to the case as indicated by arrows A and B in FIG. 6 and FIG. 7.

Levers 45 and 46, and locking pins 47 and 48, are also formed in unison with the opening/closing levers 41 and 42. The levers 45 and 46 protrude externally from a lever operating opening 16*d* formed in the opening/closing cover 16 as shown in FIG. 6. The locking pins 47 and 48 project to the outside from the side walls 16*b* as shown in FIG. 8 and fit into matching holes formed in the printer case 7 when the opening/closing cover 16 is closed.

When the outside ends of the locking pins 47 and 48 are inserted to these holes in the printer case 7, the opening/closing cover 16 is locked closed and cannot be opened. Because the force of the spring not shown urges these locking pins 47 and 48 into the locked position, the locking pins 47 and 48 remain in the locked position unless the levers 45 and 46 are operated to disengage the lock. The opening/closing cover 16 is thus reliably held in the closed position during normal operation of the data processing apparatus 1.

Figure 8:
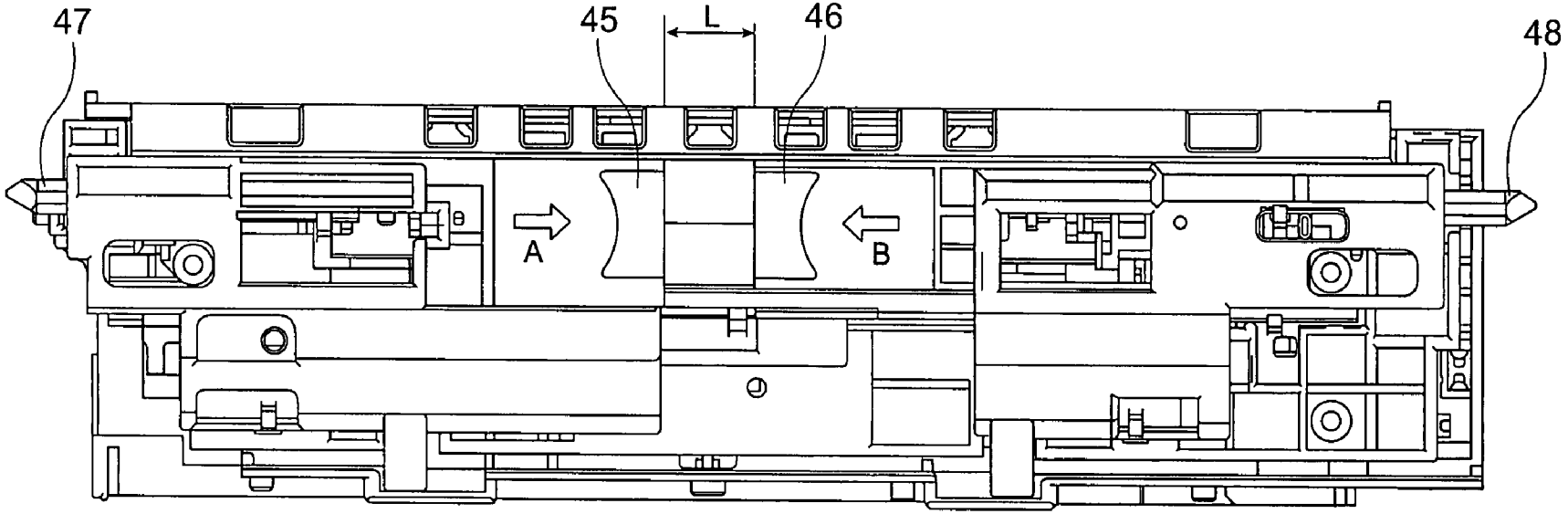
FIG. 8 is a front view showing the opening/closing levers of the guide unit shown in FIG. 3 in the locked position.

The pair of levers 45 and 46 protruding from the lever operating opening 16*d* in the opening/closing cover 16 are separated a specific distance L as shown in FIG. 8 when the locking pins 47 and 48 are in the locked position. When pressure is then applied to the outside surfaces of the levers 45 and 46 in the direction of arrows A and B in FIG. 8 so that the levers 45 and 46 move closer together, the locking pins 47 and 48 slide against the force of the spring toward the inside in a widthwise direction to the printer.

Figure 9:
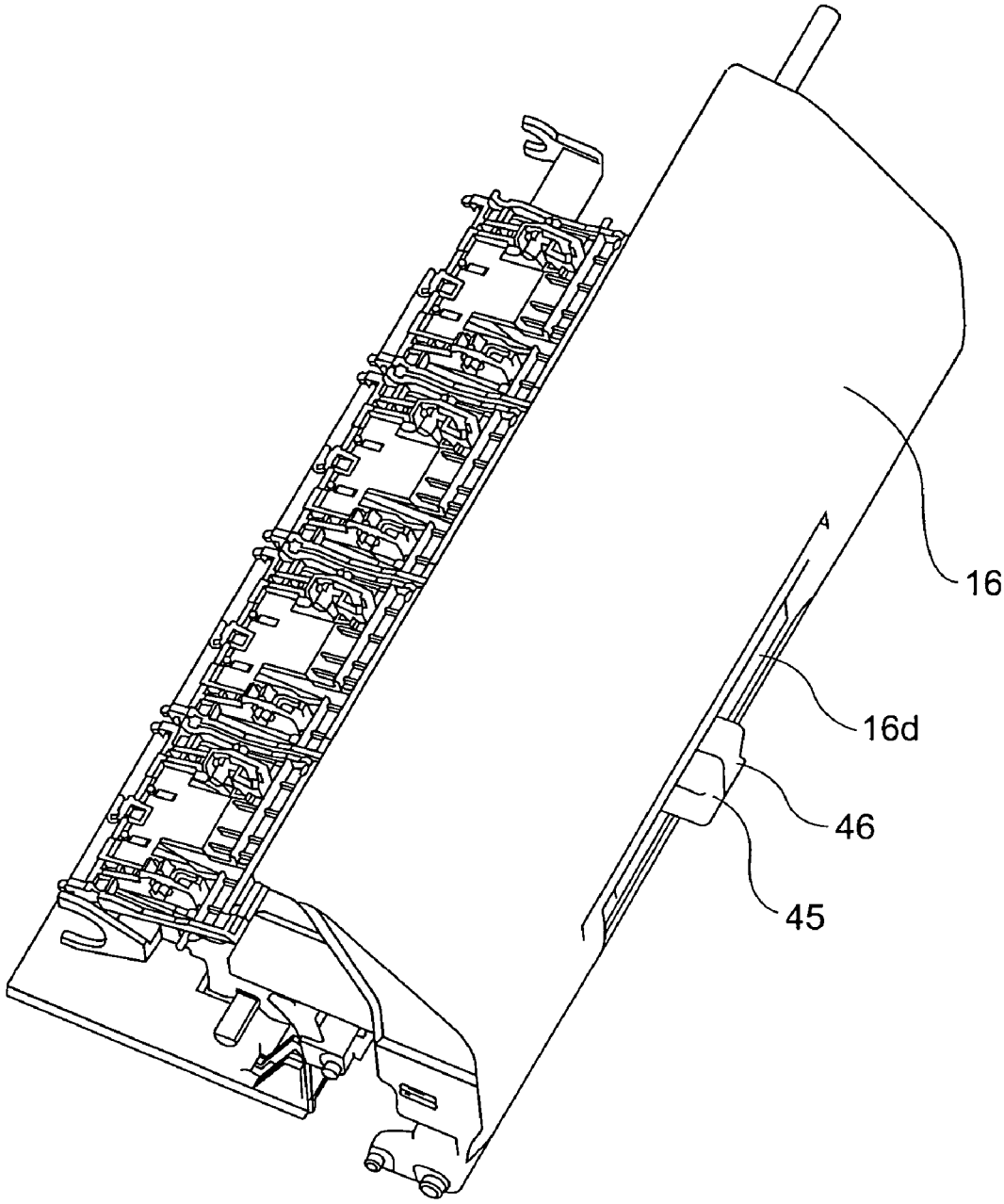
FIG. 9 is an oblique view from the back of the opening/closing cover when the opening/closing levers of the data processing apparatus shown in FIG. 2 are in the unlocked position.
Figure 10:
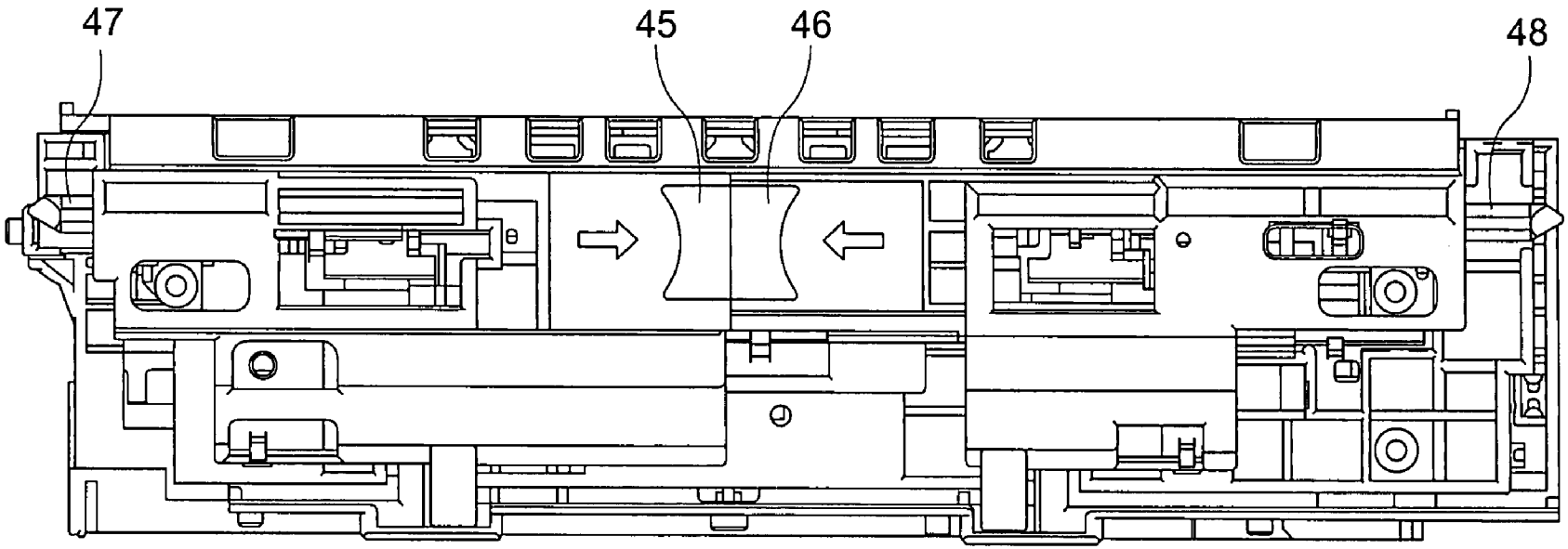
FIG. 10 is a front view showing the opening/closing levers of the guide unit shown in FIG. 3 in the unlocked position.

When the levers 45 and 46 are squeezed in contact with each other as shown in FIG. 9 and FIG. 10, the accompanying sliding motion of the locking pins 47 and 48 causes the outside ends of the locking pins 47 and 48 to retract to a position within the width of the opening/closing cover 16. The locking pins 47 and 48 thus completely disengage the matching lock holes in the printer case 7, and are unlocked from the printer case 7. Once thus unlocked, the opening/closing cover 16 can open to the rear.

As shown in FIG. 7, the guide portion 38 has a guide base 38*a* which is fixed to the inside back of the opening/closing cover 16, and a plurality of ribs 38*b* protruding from the guide base 38*a* with a specific interval therebetween across the width of the printer. The curved surface formed at the top end of each rib 38*b* forms the curved guide surface 37.

As shown in FIG. 5 to FIG. 7, an auxiliary guide member 51 is also disposed adjacent to the guide portion 38. This auxiliary guide member 51 projects from the discharge end of the guide surface 37 toward the paper feed roller pair 25 and 26 with the weight of the auxiliary guide member 51 pushing down on the paper P being conveyed toward the paper feed roller pair 25 and 26, thereby preventing the paper P from becoming skewed or lifting up. As shown in FIG. 7, this auxiliary guide member 51 has a comb-like construction with a plurality of fingers 51*a* for preventing the paper P from lifting up arrayed across the width of the printer with an appropriate distance between the fingers 51*a*.

The data processing apparatus 1 according to this embodiment of the invention also has an auxiliary guide linking mechanism 53 for moving the auxiliary guide member 51 to and away from the paper feed roller pair 25 and 26 in conjunction with locking and unlocking the opening/closing levers 41 and 42, and retracting the auxiliary guide member 51 from the paper feed roller pair 25 and 26 when the opening/closing levers 41 and 42 are unlocked.

This auxiliary guide linking mechanism 53 is composed of a first rack and pinion 55 and a second rack and pinion 57.

As shown in FIG. 7, the first rack and pinion 55 is composed of a first rack 61 and a pair of first pinions 63. The first rack 61 slides in conjunction with the sliding action of the opening/closing levers 41 and 42 when the opening/closing levers 41 and 42 are locked and unlocked. The first pinions 63 mesh with the first rack 61 and are rotationally driven by movement of the first rack 61. The first rack 61 is formed in unison with the lever portion 41*b* of opening/closing lever 41.

The second rack and pinion 57 is composed of second pinions 65 and a second rack 67. The second pinions 65 are formed coaxially to and rotate in unison with the first pinions 63. The second rack 67 has teeth which mesh with the second pinions 65 arrayed in the advancing/retracting direction of auxiliary guide member 51 movement so that the linear movement of the second rack 67 accompanying rotation of the second pinions 65 contributes to the advancing/retracting movement of the auxiliary guide member 51. The teeth of the second rack 67 are arranged at a right angle to the direction of first rack 61 movement, and rotation of the second pinions 65 thus causes the second rack 67 to move linearly perpendicularly to the direction of first rack 61 movement.

When the levers 45 and 46 of the opening/closing levers 41 and 42 are not operated to unlock, that is, when the opening/closing levers 41 and 42 are locked, the radius of movement of the distal end of the auxiliary guide member 51 from support pins 16*c* is R2 as shown in FIG. 3. If the opening/closing cover 16 is opened and pivoted on support pins 16*c* at this time, the distal end of the auxiliary guide member 51 will interfere with the support mechanism 70 supporting complementary roller 26.

Figure 11:
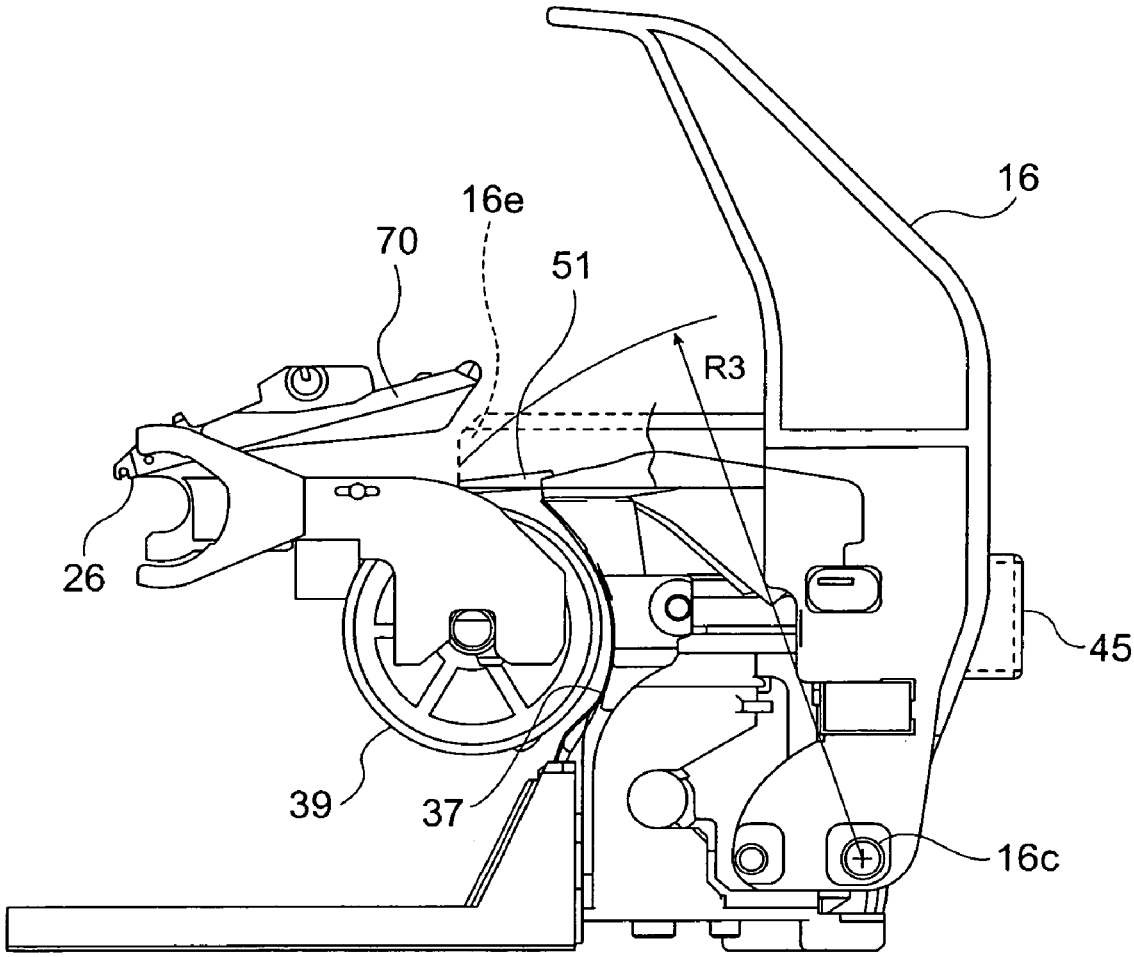
FIG. 11 is a side section view showing the auxiliary guide member in the retracted position when the opening/closing levers of the data processing apparatus shown in FIG. 1 are in the unlocked position.

However, if the levers 45 and 46 of the opening/closing levers 41 and 42 are unlocked and the auxiliary guide member 51 is retracted away from the paper feed roller pair 25 and 26 by the auxiliary guide linking mechanism 53, the distal end of the auxiliary guide member 51 moves to a position with a radius of movement R3 from the support pins 16*c*, as shown in FIG. 11. If the auxiliary guide member 51 moves circularly on support pins 16*c* at this time, the end of the auxiliary guide member 51 will not interfere with the support mechanism 70 holding the complementary roller 26, and the opening/closing cover 16 can be opened completely.

Furthermore, because the auxiliary guide member 51 is housed inside (below) the shelf 16*e* in this retracted position, the distal end of the auxiliary guide member 51 is prevented from contacting and damaging other parts inside the printer.

Figure 12:
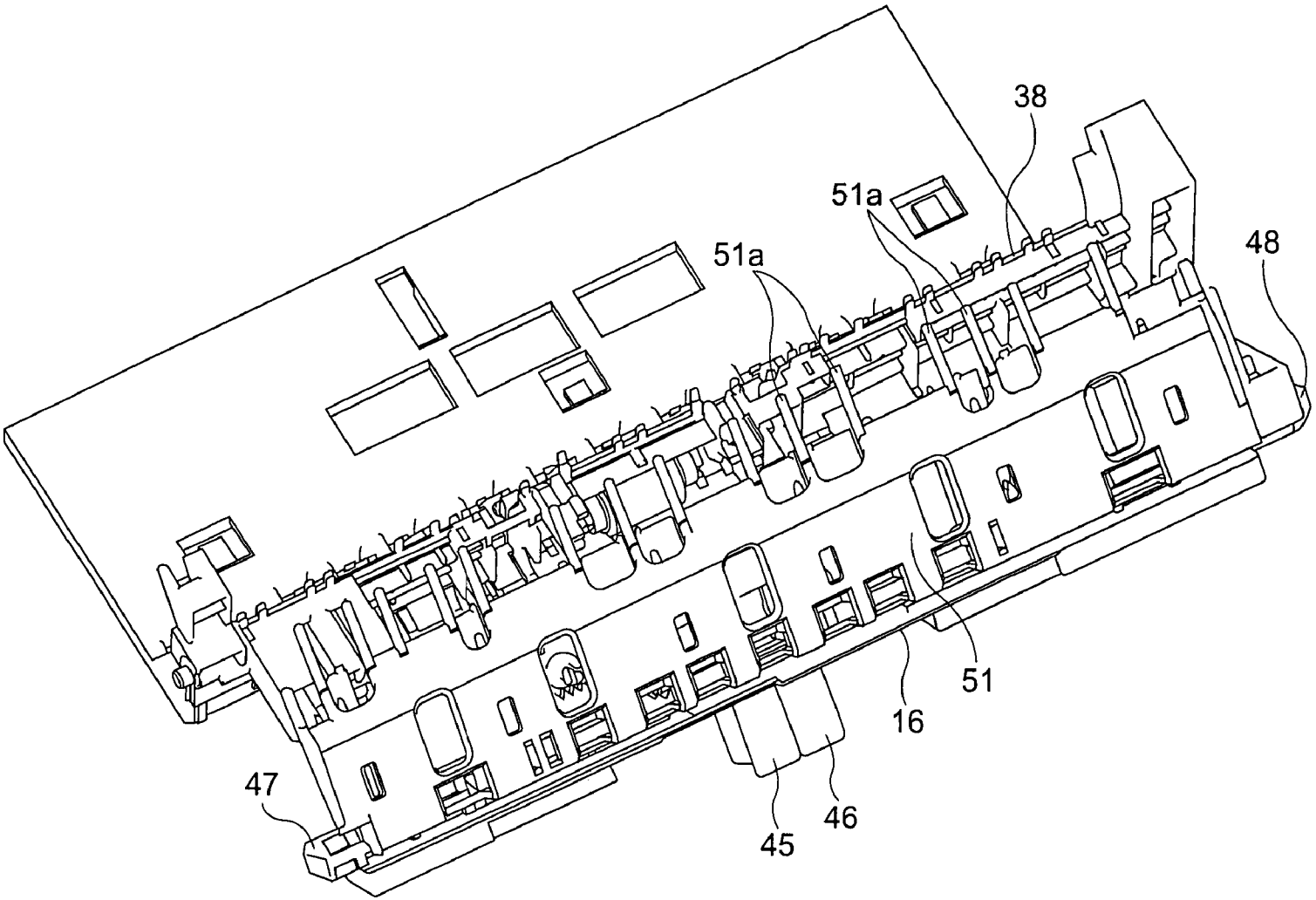
FIG. 12 is an oblique view showing the opening/closing cover of the data processing apparatus shown in FIG. 2 in the partially open position.
Figure 13:
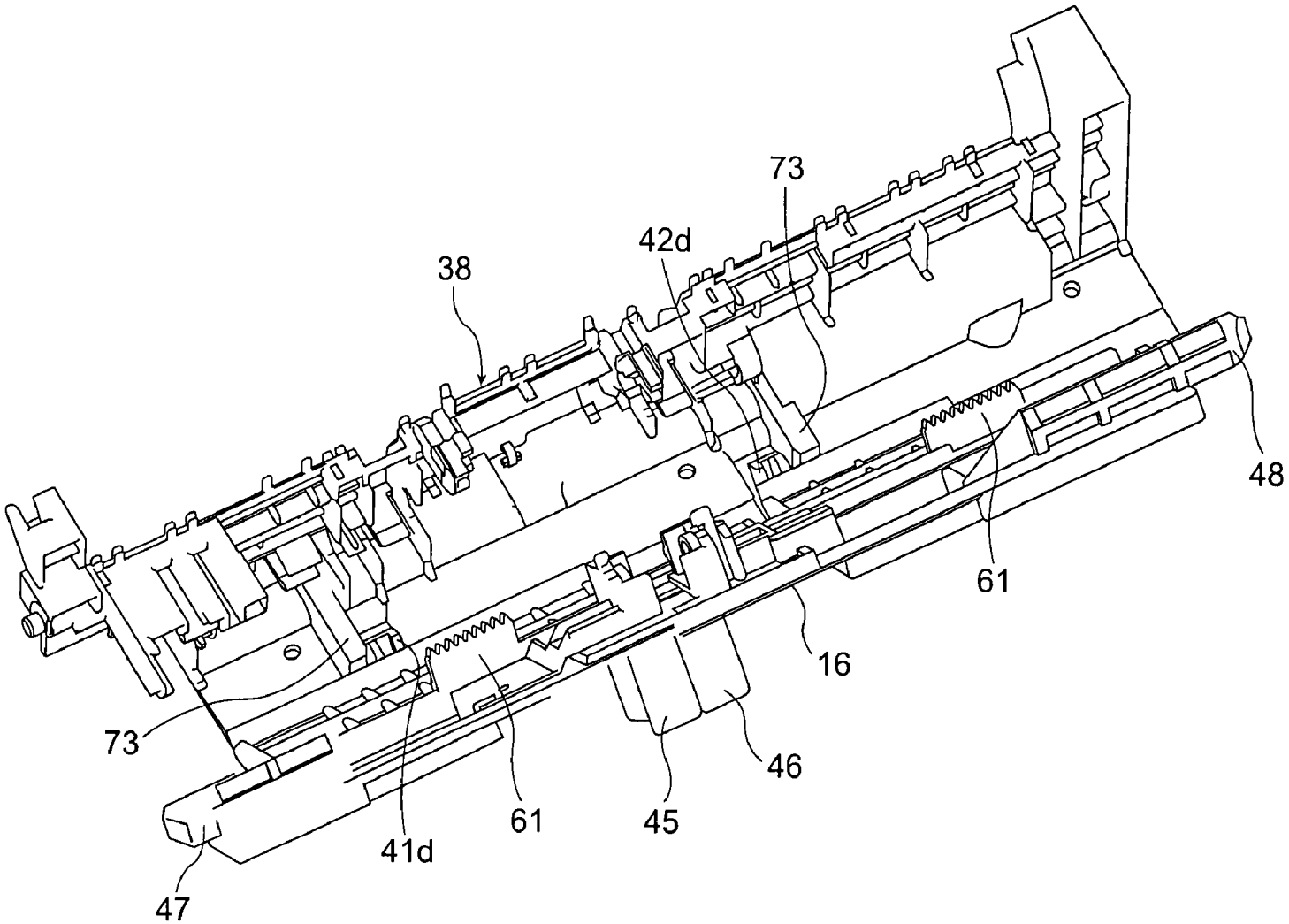
FIG. 13 is an oblique view showing the rack of the first rack and pinion exposed by removing the auxiliary guide member from the opening/closing cover shown in FIG. 12.

FIG. 12 is an oblique view showing the opening/closing levers 41 and 42 unlocked and the opening/closing cover 16 partially open, and FIG. 13 is an oblique view showing the first rack 61 of the first rack and pinion 55 exposed by removing the auxiliary guide member 51 from the guide portion 38 on the back of the opening/closing cover 16 shown in FIG. 12.

Figure 14:
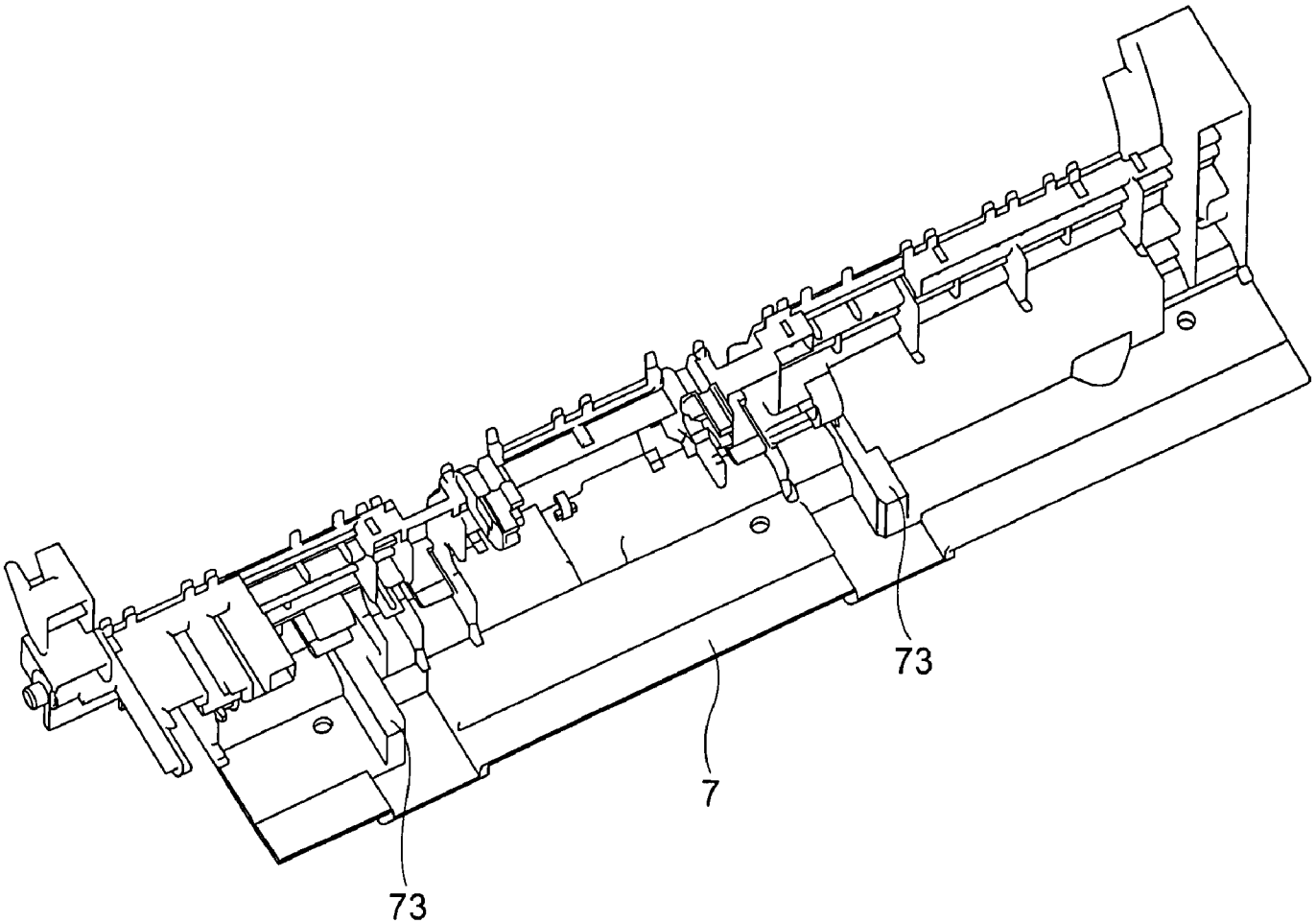
FIG. 14 is an oblique view from above the back of the printer case showing the stops for locking the opening/closing levers in the unlocked position.

As shown in FIG. 13 and FIG. 14, stops 73 are disposed at a fixed position at the bottom back end of the printer case 7. When the opening/closing levers 41 and 42 are unlocked to open the opening/closing cover 16, the opening/closing levers 41 and 42 slide to the unlocked position with their ends 41*d*, 42*d* in contact with these stops 73. These stops 73 are fixed walls formed at the back end part of the printer case 7 opposite the bottom edge of the opening/closing cover 16.

When the opening/closing cover 16 closes, the ends 41*d*, 42*d* of the opening/closing levers 41 and 42 separate from the stops 73, which thus do not interfere with locking and unlocking the opening/closing levers 41 and 42.

The auxiliary guide member 51 also advances to the paper feed roller pair 25 and 26 in conjunction with movement of the auxiliary guide linking mechanism 53 from the unlocked to the locked position of the locking pins 47 and 48. More specifically, when the locking pins 47 and 48 move to the locked position when the opening/closing cover 16 closes, the auxiliary guide member 51 moves therewith from the outlet end of the curved transportation unit 23 and is automatically positioned projecting toward the paper feed roller pair 25 and 26. As a result, when the opening/closing cover 16 is closed and the data processing apparatus 1 is driven to transport the paper P, the paper P fed from the curved transportation unit 23 by the paper feed roller pair 25 and 26 is always guided by the auxiliary guide member 51.

Because an auxiliary guide member 51 prevents the paper P fed from the curved transportation unit 23 to the paper feed roller pair 25 and 26 from skewing or lifting from the transportation path, the data processing apparatus 1 of the present embodiment can reliably feed the paper P between the curved transportation unit 23 and paper feed roller pair 25 and 26 with high precision and stability.

Furthermore, because the auxiliary guide member 51 is attached to the guide portion 38, which is attached to the inside of the opening/closing cover 16 of the printer case 7, a mechanism dedicated to supporting the auxiliary guide member 51 need not be rendered on the printer case 7 side. As a result, the assembly process is not complicated by an increase in parts needed to assemble the auxiliary guide member 51 to the printer case 7.

Figure 15:
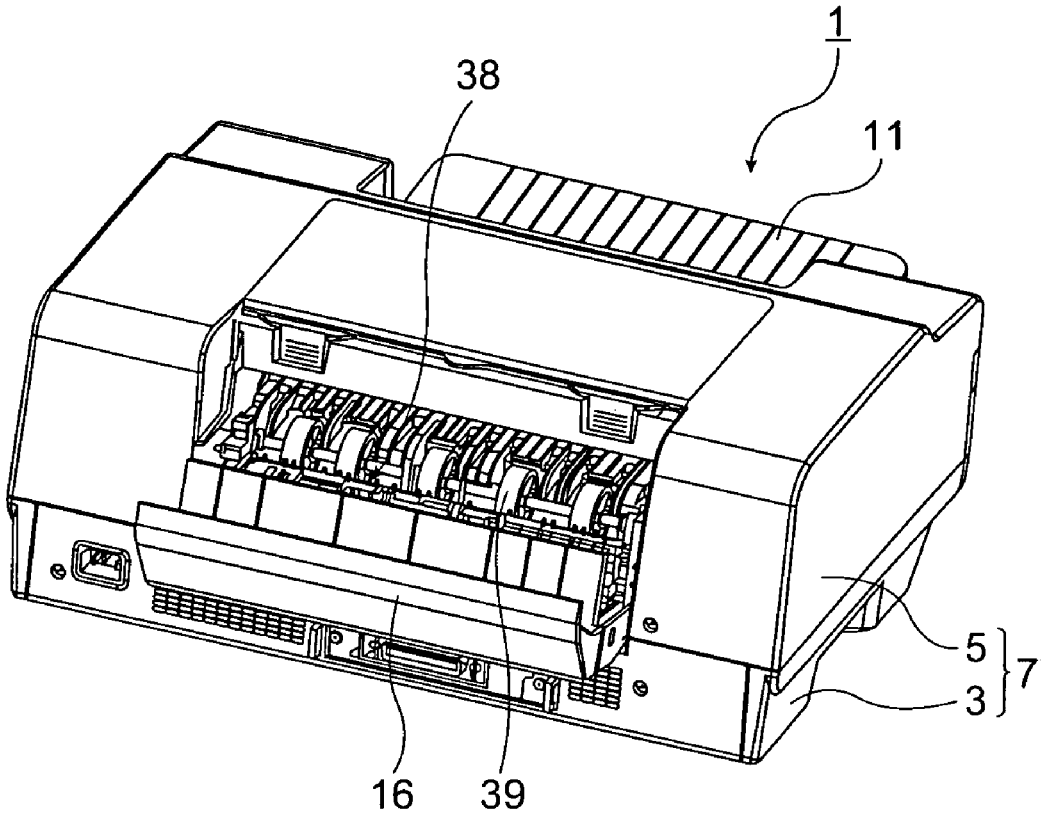
FIG. 15 is an oblique view showing the opening/closing cover of the data processing apparatus shown in FIG. 2 open.

Furthermore, if a paper jam occurs inside or near the curved transportation unit 23, the paper jam can be exposed by unlocking the opening/closing levers 41 and 42 and opening the opening/closing cover 16 and guide portion 38 as shown in FIG. 15. In addition, because the auxiliary guide member 51 retracts inside the guide portion 38 in conjunction with operation of the opening/closing levers 41 and 42 when the opening/closing levers 41 and 42 are unlocked, the projection of the auxiliary guide member 51 from the guide portion 38 to the paper feed roller pair 25 and 26 side is reduced as shown in FIG. 11. The auxiliary guide member 51 is also housed inside the shelf 16*e* and protected from contact with other parts. The auxiliary guide member 51 is thus prevented from interfering with the neighboring support mechanism 70 when the opening/closing cover 16 and guide portion 38 open and close, the layout of other components inside the printer case 7 is not restricted by the need to avoid interference with the auxiliary guide member 51, and the opening/closing mechanism of the guide portion 38 can be easily incorporated.

Furthermore, because the area where paper jams are likely to occur inside the printer can be exposed by opening the opening/closing cover 16 (see FIG. 15), jammed paper can be accessed directly by the user when a paper jam occurs. The paper P can thus be easily removed and the paper quickly corrected.

Furthermore, when the opening/closing levers 41 and 42 are unlocked to correct a paper jam in the data processing apparatus 1 according to this embodiment of the invention and the opening/closing cover 16 starts to open, the ends 41*d*, 42*d* of the opening/closing levers 41 and 42 are locked in the unlocked position by the stops 73 on the printer case 7. The opening/closing levers 41 and 42 thus are held in the unlocked position even after the user releases the opening/closing levers 41 and 42, thus making opening and closing the opening/closing cover 16 easier. Furthermore, because the auxiliary guide member 51 is held in the retracted position when the opening/closing cover 16 is open, the auxiliary guide member 51 does not interfere with removing jammed paper P.

Yet further, when the opening/closing cover 16 is closed after removing jammed paper P, the locking pins 47 and 48 are held in the unlocked position by the stops 73 until the opening/closing cover 16 returns to the normal closed position. The opening/closing cover 16 can therefore be returned to the fully closed position without operating the opening/closing levers 41 and 42 and without the auxiliary guide member 51 striking other members.

In addition, when the opening/closing cover 16 returns to the closed position and the opening/closing levers 41 and 42 disengage the stops 73, the force of the spring automatically moves the opening/closing levers 41 and 42 to the locked position, thereby securing the opening/closing cover 16 to the printer case 7. In other words, closing the opening/closing cover 16 is also quite simple.

The length of the linear movement of the second rack 67 can be desirably adjusted in the foregoing data processing apparatus 1 by adjusting the gear ratio between the first pinions 63 and second pinions 65. The linear distance of auxiliary guide member 51 movement can thus be desirably set without being limited by the distance the opening/closing levers 41 and 42 must move to lock and unlock, and an auxiliary guide member 51 that projects the necessary sufficient distance can be smoothly advanced and retracted.

Furthermore, because the first rack 61 is formed in unison with the opening/closing lever 41, a separate part functioning as the auxiliary guide linking mechanism 53 for advancing and retracting the auxiliary guide member 51 can be omitted by forming the second rack 67 in unison with the auxiliary guide member 51, for example. The number of parts to be assembled can thus be reduced, and the assembly process can be simplified.

A data processing apparatus according to the present invention shall not be limited to a printer as described by way of example above. More specifically, the present invention can be applied in a photocopier, a fax machine, a money changing machine, a ticket-issuing machine, or other type of apparatus having a similarly U-shaped transportation path or a complex transportation path having a plurality of curved transportation portions for conveying transported media.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A data processing apparatus comprising a guide unit having an intermediate roller and an arc-shaped guide surface composing a substantially arc-shaped curved transportation unit inside an external case;

a paper feed roller pair, which nips and conveys a transported medium conveyed from said curved transportation unit toward a processing position, disposed at a specific distance from a discharge end of said curved transportation unit, wherein said guide unit comprises an auxiliary guide member which projects from said discharge end of said curved transportation unit toward said paper feed roller pair and guides said transported medium conveyed toward said paper feed roller pair, said guide unit rendered to move circularly and open and close in unison with an outside wall portion of said external case positioned on the outside of said guide unit;

opening/closing levers for locking and unlocking a lock unit which restricts circular motion of said guide unit in a closed position; and an auxiliary guide linking mechanism for retracting said auxiliary guide member in a direction separating from said paper feed roller pair in conjunction with said unlocking operation of said lock unit by said opening/closing levers.

2. The data processing apparatus described in claim 1, wherein said auxiliary guide member advances and retracts in the direction of said paper feed roller pair in conjunction with movement between said unlocked position and said locked position of said lock unit.

3. The data processing apparatus described in claim 1, wherein said auxiliary guide linking mechanism comprises:

a first rack which moves linearly in conjunction with an unlocking operation of said opening/closing levers;

a first pinion which meshes with said first rack and rotates in conjunction with linear movement of said first rack;

a second pinion which rotates codirectionally to said first pinion; and a second rack which has teeth which mesh with said second pinion arrayed in the retracting direction of said auxiliary guide member, and retracts said auxiliary guide member as a result of linear motion of said second rack in conjunction with rotation of said second pinion.

4. The data processing apparatus described in claim 1, further comprising stops which contact said opening/closing levers in said unlocked position when said guide unit is in said open position, and hold said lock unit in said unlocked position.

5. The data processing apparatus described in claim 1, wherein said lock unit is elastically urged toward said locked position.

6. The data processing apparatus described in claim 1, wherein said auxiliary guide member is housed in a flange member which moves circularly in conjunction with said outside wall portion when said auxiliary guide member retracts away from said paper feed roller pair.

7. The data processing apparatus described in claim 3, wherein the first rack is formed in unison with one of said opening/closing levers.

8. The data processing apparatus described in claim 3, wherein the second rack is formed in unison with said auxiliary guide member.

* * * * *